US007640598B1

(12) United States Patent
Mallik

(10) Patent No.: US 7,640,598 B1
(45) Date of Patent: Jan. 5, 2010

(54) INFANT CAREGIVER PADDED PILLOW GARMENT

(76) Inventor: Margot Mallik, 1014 Northrope Dr., Atlanta, GA (US) 30324

( * ) Notice: Subject to any disclaimer, the term of this patent is extended or adjusted under 35 U.S.C. 154(b) by 0 days.

(21) Appl. No.: 12/411,846

(22) Filed: Mar. 26, 2009

(51) Int. Cl.
*A41D 13/05* (2006.01)

(52) U.S. Cl. ..... 2/46; 2/48; 2/49.1; 2/463

(58) Field of Classification Search ..... 2/46, 2/48, 49.1–49.5, 51, 52, 463, 464, 461, 92, 2/69, 94, 102, 267, 462; 128/845, 874, 875, 128/857; 602/5, 6, 19, 16; 5/630, 655, 655.9, 5/636

See application file for complete search history.

(56) References Cited

U.S. PATENT DOCUMENTS 525,710 A * 9/1894 Keough ..... 2/455
558,812 A * 4/1896 Hunt ..... 2/455
876,237 A * 1/1908 Ridlom ..... 2/463
932,352 A * 8/1909 Sullivan ..... 2/462
2,831,193 A * 4/1958 Terry ..... 2/46
4,393,520 A * 7/1983 Koch ..... 2/16
5,154,691 A * 10/1992 Box et al. ..... 602/5
D340,784 S * 10/1993 Clayton ..... D29/101.1
5,692,246 A * 12/1997 Benedick ..... 2/463
5,709,000 A * 1/1998 Hansen et al. ..... 5/655
5,960,471 A * 10/1999 Burton ..... 2/48
7,316,035 B2 * 1/2008 Archambault ..... 2/46
2005/0066405 A1 * 3/2005 Babiak ..... 2/48

* cited by examiner

*Primary Examiner*—Amy B Vanatta
(74) *Attorney, Agent, or Firm*—Donald W. Meeker

(57) ABSTRACT

An infant caregiver's padded pillow garment has a single shoulder strap on one side. An outer breathable water resistant cover shields an inner memory foam pad. Teething items and toys on tethers are removably clipped to an edge of the garment. The garment covers the upper front torso and shoulders for holding the infant to cushion the infant's head banging the caregiver's bones. The garment folds in half vertically along a stitched vertical fold line and flips over to the back of the caregiver with the strap over the front for normal activity without holding the infant. The padding conforms to the shape of the caregiver's body from thick over the boney body portions tapering to thin over the upper breast.

10 Claims, 3 Drawing Sheets

INFANT CAREGIVER PADDED PILLOW GARMENT

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH OR DEVELOPMENT

Not Applicable.

BACKGROUND OF THE INVENTION

1. Field of the Invention

The present invention relates to infant caregiver torso cover and in particular to a padded cushion with a shoulder strap that shifts from a first position in use to cover and provide shape conforming padding to a front upper torso and shoulder of a caregiver holding an infant and folds in half and shifts back to a second position onto the back of the caregiver when not in use to provide unimpeded normal daily activity and intermittent frequent protection of an infant's head and a caregiver's clothing and body while holding an infant.

2. Description of Related Art Including Information Disclosed Under 37 CFR 1.97 and 1.98

A common way for an adult caregiver for an infant to carry a baby is to cradle the baby in one arm or both arms, so that the baby's head is resting on one of the adult's shoulders. However, the infant's head bobs away from and toward the body of the caregiver and the infant's head may bang against the caregiver's body hitting the caregiver's collar bone or shoulder bones or chest bones causing pain and possible injury to the infant. Furthermore, the infant may drool onto the caregiver. In various caregiving operations and daily activities, the infant may be laid down and picked up many times and often in short intervals, so that any protective padding for the infant should be able to be moved and set in place rapidly to accommodate the constant intermittent need for the protective padding. While there have been a number of devices for covering a caregiver's clothing to protect the clothing, very few are padded to protect the head of the infant from banging against the caregiver and none of the prior art devices adequately address these problem of frequent intermittent use of a padded device to protect an infant's head as well as the clothing and body of the caregiver.

Prior art U.S. Patent application #20050066405, published Mar. 31, 2005 by Babiak, provides a cushioned torso covering for an adult/parent/babysitter to wear while rocking, burping, feeding, and holding an infant. It is filled/padded and is fastened around the back of the neck, can be tightened around the waist for the right fit, and covers the entire front torso and front/back of shoulders. The entire front of the covering is filled/padded (pillow like qualities) to provide comfort and protection for both the infant and the adult. The infant is protected from zippers, snaps, buttons, jewelry, collar bones, dirty clothing and is comforted by the feel of the padding. The adult wearing this product is further protected from spit up and is more comfortable while holding the infant.

Prior art U.S. Pat. No. 5,709,000, issued Jan. 20, 1998 to Hansen et al, provides a combination baby pillow and drool guard that includes a shell stuffed with soft batting. A hole is arranged on the pad, so that it may be worn around the neck of the adult. The pad covers the shoulders and upper chest area of the adult to cushion the baby's head, and to protect the adult's clothing from the baby's drool. In a first embodiment, a pair of straps connect the opposite ends of the pad together when worn. In a second embodiment, a releasable joint extends between the hole and an edge of the pad for facilitating donning and removal. In a third embodiment, the pad includes a pair of wings extending from the sides for providing extra coverage on the adult's shoulders.

Prior art U.S. Pat. No. 7,316,035, issued Jan. 8, 2008 to Archambault, describes a multi-purpose burp cloth which allows parents or care-givers to perform other activities while feeding his or her baby by bottle that also acts as a baby diaper changing pad and pacifier holder. The burp cloth has a front side and a back side that are attached to one another by stitching. A pillow is located at an upper portion of the burp cloth and a clip is located just below the pillow on the front component while a strap is attached to the front side. To use the cloth, the user simply wraps the strap around the bottle and attaches the fastening means on a strap outer surface to a fastening means located on a strap inner surface. An alternate embodiment includes an adjuster located on a strap pair wherein the user feeds the end portion of the strap through the adjuster and pulls the strap so as to make the strap tight against the bottle. To use the cloth as a baby diaper changing pad, the user simply flips the cloth so that the back side is face up, places the baby's head onto the pillow and changes the diaper. The user may then wipe the back side with a disinfecting wipe to kill the germs.

Prior art U.S. Pat. No. 2,831,193, issued Apr. 22, 1958 to Terry, discloses a garment for use in the care of infants having a front and back panel over one shoulder of the parent with a strap around the torso of the user. The garment includes some padded portions.

Prior art U.S. Pat. No. 7,082,617, issued Aug. 1, 2006 to Poindexter et al, shows a protective garment, much like a bib having an outer surface and inner surface for disposition over a user's clothes. The bib comprises, a back panel having an upper and a lower edge, a pair of shoulder panels extending from the upper edge of the back panel, each shoulder panel having a medial end and a lateral end, a neck opening having a peripheral border defined by the upper edge of the back panel and respective medial ends of said shoulder panels, two chest panels, each having a medial and lateral side, depending from an associated shoulder panel in laterally spaced apart relation to one another, thereby defining a generally longitudinal opening therebetween, a fastener associated with at least one of the medial sides of the chest panels for releasably joining the chest panels together in overlapping fashion so that said generally longitudinal opening is closed releasably.

Prior art U.S. Pat. No. 5,950,235, issued Sep. 14, 1999 to Tata, claims a protective garment for use by an adult with an infant comprises a body portion, a neck opening portion and a fastener. A protective drape for an adult feeding a child has a soft top layer and a bottom layer with an impervious ply and a soft material ply and has a neck opening and a hook and loop fastener. The body portion comprises a first and second edge connecting to form a non-zero angle with respect to each other. The neck opening portion forms an opening in the body portion with the neck opening portion being disposed opposite the non-zero angle of the body portion, such that a line bisecting the non-zero angle to the closest point of the neck opening portion passes through the center of the neck opening portion and forms an axis of symmetry for the body portion.

Prior art U.S. Pat. No. 7,048,160, issued May 23, 2006 to Anderson, indicates an infant feeding and entertainment support comprising a front panel and a rear panel detachably affixed thereto with the front panel alternatively adapted to include bottle feeding holder means, breast feeding veil means, burping cloth, as well as infant-oriented entertainment items.

Prior art U.S. Pat. No. 5,960,471, issued Oct. 5, 1999 to Burton, puts forth a protective garment for feeding, burping, nursing, and changing diapers of a baby, the garment having a main body member that may be secured about the neck and over the shoulders of a wearer, comprising an inner layer made from a waterproof material, such as vinyl, and an outer absorbent layer attached preferably on either side of the inner layer. The outer layer is made from soft material, such as cotton, fleece, flannel, or the like, which is suitable for soft contact with a baby's skin. A cloth member is removably attached to the front outer portion of the outer layer, and is used as a washcloth or napkin to clean a baby during or after feeding or burping. In the preferred embodiment, the front outer layer of the main body member includes a pair of pockets, having an elastic band about the top of the pockets for retaining baby bottles or other baby care items. The back outer layer contains a plurality of pockets on a bottom portion, and also includes a small pocket adjacent the neck area for containing a small musical device. Other features described herein include a lap pad, removably secured on the back outer layer, which can be folded down over the wearer's lap for changing diapers, glow in the dark designs on the front outer layer, VELCRO loops for holding teething rings, pacifiers, baby keys, and the like, and openings provided adjacent a female wearer's breasts for providing access for a baby to the breast for nursing.

Prior art U.S. Pat. No. 2,955,293, issued Nov. 11, 1960 to Peterson, concerns a protective shoulder cover worn by an adult for feeding and burping infants having a front and back panel over one shoulder of the user. It includes an inner layer of foam padding, but the padding is intended to prevent the cover from slipping and may not necessarily be thick enough to soften a banging of an infant's head against the body of the adult.

Prior art U.S. Pat. No. 4,873,725, issued Oct. 17, 1989 to Mitchell, illustrates an apron-type garment for the use of parents of infants in which many of the necessities for child care are kept close at hand. Specialized pockets conveniently located on a front panel of the garment provide for the storage of milk bottles, bibs, diapers, baby powder, and the like. Made of a thick, quilted fabric, the garment not only is gentle against the child's skin but also absorbs moisture and thereby protects the wearer's clothes against their being soiled while the wearer is attending to the needs of the child. The body of the garment includes, in addition to the front panel, two rear panels each of which is about one-half as long as the front panel. Contiguous portions of the front and rear panels form a pair of flared sections covering the wearer's shoulders and extending laterally therefrom. These flared sections together with the lower portions of the rear panels cover the caregiver's back to her waist, thereby allowing her to let the child rest his head on her shoulder, even after a meal, without having to worry about clothes worn beneath this garment becoming soiled as the infant exercises a natural tendency to regurgitate.

What is needed is an easily movable padded infant head cushion to be worn by a caregiver and easily shifted behind onto the back of a user when not holding the infant and instantly shifted back to an upper torso and shoulder covering position when lifting and carrying the infant providing convenient constantly available protective padding for the infant while allowing a caregiver freedom of movement and activity when not holding the infant. The easily movable padded infant head cushion should be able to be moved and set in place rapidly to accommodate frequent intermittent use of the padded device to protect an infant's head as well as the clothing and body of the caregiver.

BRIEF SUMMARY OF THE INVENTION

An object of the present invention is to provide an easily movable padded infant head cushion to be worn by a caregiver and easily shifted behind onto the back of a user when not holding the infant and instantly shifted back to a torso and shoulder covering position when lifting and carrying the infant providing convenient constantly available protective padding for the infant while allowing a caregiver freedom of movement and activity when not holding the infant; the padded cushion is easily moved and set in place rapidly to accommodate frequent intermittent use of the padded device to protect an infant's head as well as the clothing and body of the caregiver.

Another object of the present invention is to provide an easily movable padded infant head cushion to be worn by a caregiver which allows easy access for breastfeeding.

An added object of the present invention is to provide an easily movable padded infant head cushion to be worn by a caregiver which has infant amusement devices, such as a teething ring, a teething cloth, a pacifier, and/or toys, removably attached to an edge of the padded pillow garment by a removable clip and a tether for easy access for the infant.

In brief, a padded pillow preferably formed of memory foam from 1⅛" to 1½" thick over the upper boney portions of the front torso of a caregiver for an infant, which in use covers and provides shape conforming padding to the upper front torso and over a portion of the shoulders and partially encircling a portion of the neck of a caregiver to form a cushion guard padded pillow garment to protect an infant's head from pain and injury when bobbing against the caregiver. The padded pillow garment also protects the caregiver's body from injury and clothing from becoming soiled. The padding preferably tapers to a thinly padded portion over the soft upper portion of the breasts of the caregiver so that the overall garment conforms to the shape of the torso of the caregiver with a relatively low profile. The thickest padding should prevent injury to the infant from banging the infant's head against the caregiver, but be thin enough to prevent the infant's face from sinking into the padding and thereby avoid stifling the infant.

A single shoulder strap supports the padded pillow garment when in use in combination with the friction of the padded pillow garment against the caregiver's body and enables the padded pillow garment to be folded in half along a stitched thin vertical fold line, which allows easy folding around the vertical fold line, and swung around onto the caregiver's back with the strap holding it there to enable the caregiver to engage in normal daily activity when not holding the infant.

The padded pillow garment preferably covers the upper third of the torso of the caregiver partially covering the breasts of the caregiver to enable easy lifting of the padded pillow garment for breast feeding.

The padding over the shoulder and upper torso has a thickness sufficient to protect a child's head from pain and damage when the infant's head bangs against a caregiver's bone areas and the padding tapers at the bottom over the breast area which is naturally padded, so that the soft bendable padded garment conforms to the shape of the wearer and provides padding only where needed.

A breathable, preferably organic, water resistant fabric covers the outer face of the padded pillow garment to protect the clothing of the caregiver from fluids spilled in feeding or emitted from the mouth of the infant. The fabric may be colored, imprinted and decorated as desired. The back covering should have a relatively high friction material to help prevent the padded pillow garment from slipping down when in use.

A teething ring, a pacifier and/or one or more small toys may be attached to the edge of the padded pillow garment by strings, tethers, cords, clips, ribbons, or elasticized straps or loops clipped onto the garment for instant use by the infant.

An advantage of the present invention is that it provides protection from injury for an infant's head.

Another advantage of the present invention is that it provides protection from injury for a caregiver's shoulders, collar bones and upper torso.

An added advantage of the present invention is that it protects a caregiver's clothing from becoming soiled.

An ensuing advantage of the present invention is that it provides easy and rapid access for frequent intermittent use.

One more advantage of the present invention is that it is easily stored in a non-use position.

Yet another advantage of the present invention is that is easily accessible for frequent use.

An additional advantage of the present invention is that it provides easy access for breastfeeding.

A further advantage of the present invention is that it provides amusement articles for the infant.

One more advantage of the present invention is that it conforms to the shape of the body of the wearer.

BRIEF DESCRIPTION OF THE SEVERAL VIEWS OF THE DRAWINGS

These and other details of the present invention will be described in connection with the accompanying drawings, which are furnished only by way of illustration and not in limitation of the invention, and in which drawings.

DETAILED DESCRIPTION OF THE INVENTION

Figure 1:
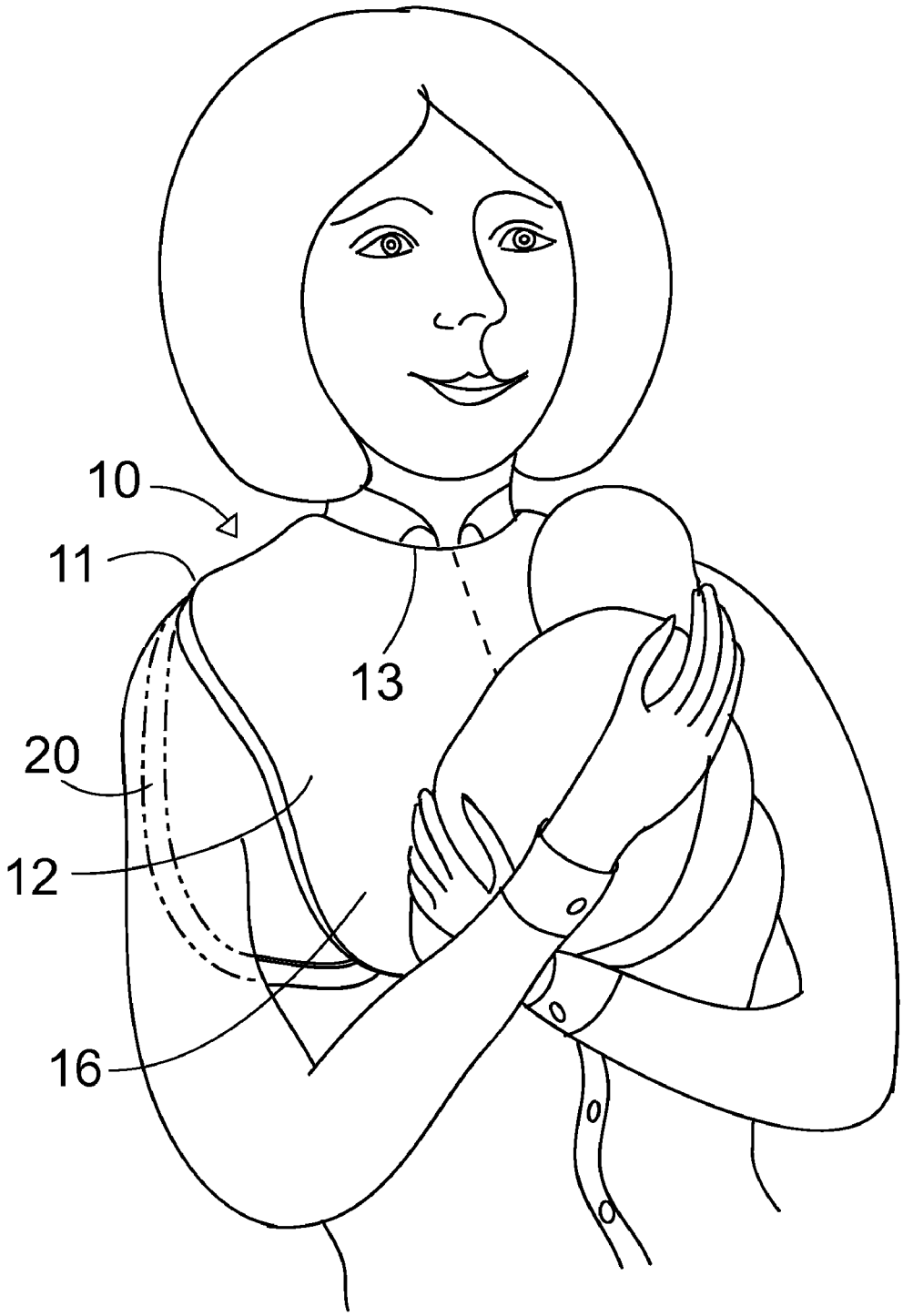
FIG. 1 is a perspective view showing the padded pillow protective garment of the present invention worn on an upper front torso of a caregiver for holding an infant.
Figure 5:
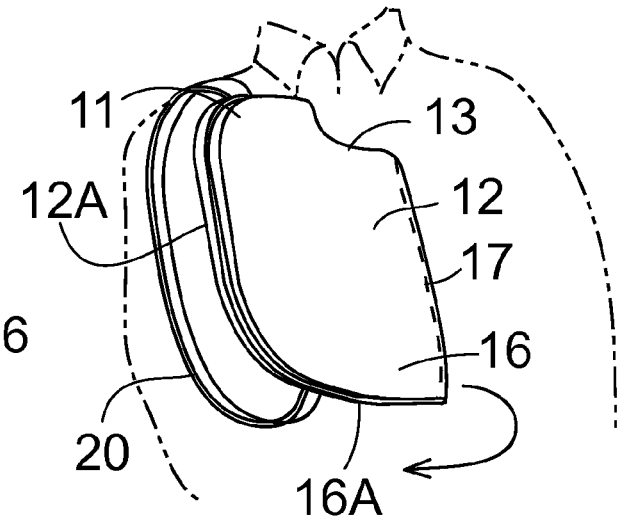
FIG. 5 is a perspective view of the padded pillow protective garment of the present invention shown with a second side of the padded pillow garment folded and tucked under the first side having the shoulder strap.
Figure 6:
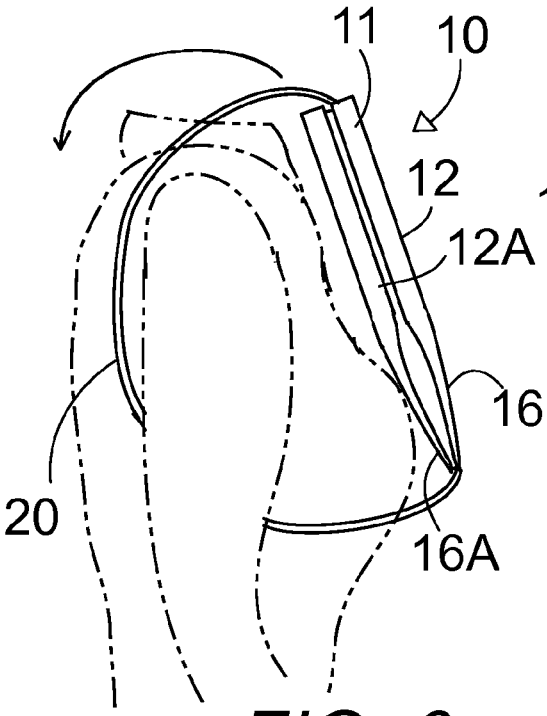
FIG. 6 is a side elevational view of the padded pillow protective garment of the present invention shown with a second side of the padded pillow garment folded and tucked under the first side having the shoulder strap.
Figure 7:
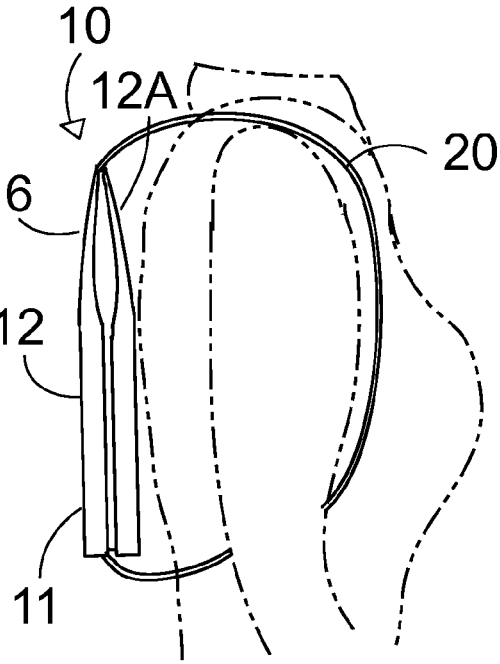
FIG. 7 is a side elevational view of the padded pillow protective garment of the present invention shown with a second side of the padded pillow garment folded and tucked under the first side having the shoulder strap and the padded pillow garment slung over and hanging down the back of the caregiver for carrying the padded pillow garment with the strap in front around the shoulder for normal activity without holding the infant.

In FIGS. 1-7, a padded pillow protective garment 10 is worn on a front upper torso of a caregiver for use in holding an infant, as shown in FIG. 1, and alternately retained on a back of the caregiver, as shown in FIG. 7, during normal activity when not holding the infant.

The padded pillow garment 10 comprises a semi-circular neck encircling portion 13, a full-thickness cushioned shoulder covering portion 11, a full thickness upper torso covering portion 12, a tapered thickness breast covering portion 16 thereby conforming to the shape of the shoulders, upper front torso, and upper breast area of a caregiver of an infant so that boney portions of the caregiver's body are cushioned thereby to cushion contact of the boney portions by the infant.

Figure 4:
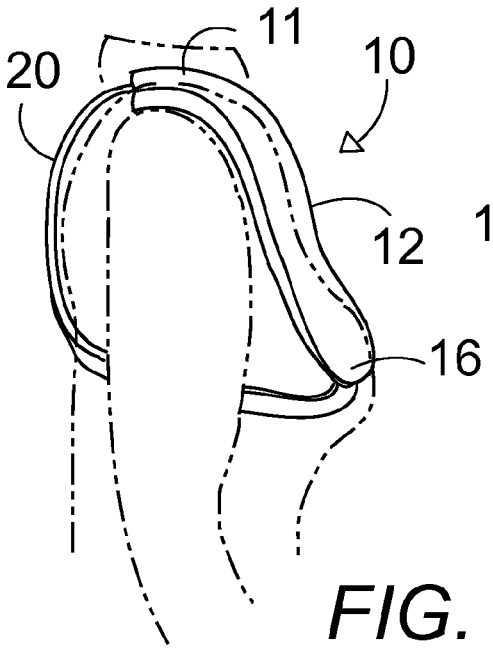
FIG. 4 is a side elevational view of the padded pillow protective garment of the present invention worn on an upper front torso of a caregiver for holding an infant.

The padded pillow garment 10 also comprises a strap 20 between a top and bottom of a first side 12 and 16 of the padded pillow garment 10. The strap 20 encircles around the back of a shoulder of the caregiver to hold the padded pillow garment 10 in place on a front of the caregiver's body during use while holding an infant, as shown in FIGS. 1 and 4, to protect the infant's head from pain and injury when bobbing against the caregiver and for protecting the caregiver's clothing and body. The strap 20 is also used for encircling around the front of a shoulder of the caregiver with a second side 12A and 16A of the padded pillow garment 10 folded under the first side 12 along a thin stitched vertical fold line 17, as shown in FIG. 5, and the padded pillow garment 10 slung back over the shoulder, as indicated in FIG. 6, and hanging down on the back of the caregiver when not holding an infant, as shown in FIG. 7. The back-worn position shown in FIG. 7 enables normal activity with a free range of motion by the caregiver while retaining the padded pillow garment 10 ready for instant use when needed for holding an infant. In holding the cushion portion 12 of the padded pillow device 10, the single strap 20 allows immediate and frequent access to the readily available padded pillow protective garment 10 which is worn on a front upper torso of a caregiver for use in holding an infant, as shown in FIGS. 1 and 4, and alternately retained on a back of the caregiver during normal activity when not holding the infant, as shown in FIG. 7.

The padded pillow garment 10 is configured to cover and conform to the shape of an upper third of the front torso of the caregiver, as shown in FIGS. 1 and 4, partially covering the breasts of the caregiver with the tapered padding thinner bottom 16 of the garment to enable easy lifting of the cushion portion 12 of the padded pillow garment 10 for breast feeding.

Figure 3:
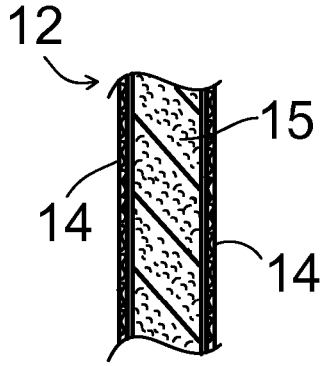
FIG. 3 is a partial cross-sectional view taken through the torso covering portion of the padded pillow garment of FIG. 2 showing the internal memory foam covered by fabric on both sides.

The cushion portion 12 of the padded pillow garment 10 is fabricated from sheet of memory foam 15, as shown in FIG. 3, the memory foam 15 being 1⅛" to 1½" thick at the top and tapering to a thin padding at the bottom, and which is shaped to form the padded pillow garment 10. The padded pillow garment 10 further comprises a covering 14 on the cushion 12, as shown in FIG. 3, formed of a breathable water resistant fabric 14 to cover the outer face of the memory foam 15 inside the padded pillow garment 10 to protect the clothing of the caregiver from fluids spilled in feeding and emitted from the mouth of the infant. The fabric 14 preferably comprises an organic breathable water resistant fabric which may be colored, imprinted, and decorated as desired. The back of the covering preferably has at least a portion covered by high friction material to help maintain the padded pillow garment in place during use and help prevent slipping.

Figure 2:
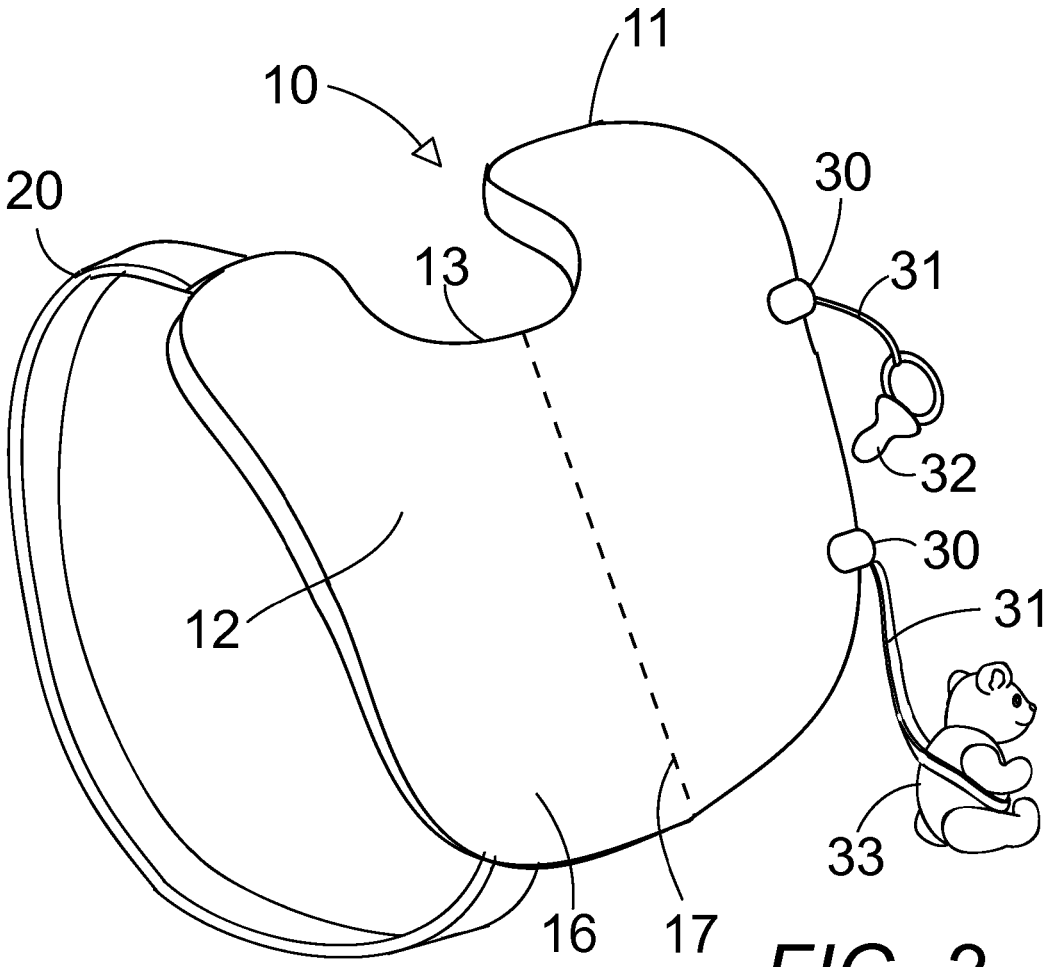
FIG. 2 is a perspective view of the padded pillow protective garment of the present invention with a teething ring and a stuffed teddy bear each attached to an edge of the padded pillow garment by a removable clip and a tether.

The padded pillow garment 10 further comprises one or more clips 30 removably attachable to an edge of the cushion portion 12 of the padded pillow garment 10, as shown in FIG. 2. Each clip 30 is connected to an elongated element 31, such as a tether or cord or rubberized cord for attaching an infant's toy 33 or teething ring 32 to the padded pillow garment 10. A variety of items (some of which are not shown) may be attached to the elongated element 31 for instant use by an infant, these items may be taken from the list of items used by an infant comprising a teething ring 32, a teething cloth, a pacifier, a small toy, a small stuffed animal 33, a small doll, a small action figure, and/or a rubberized toy. Alternately, other fastening systems (not shown) such as hook and loop fastener systems, tie strings, buttons, or snaps may be used to attach the infant amusement items 32 and 33 to the padded pillow garment 10.

In use, the cushion portion 12 and 16 of the padded pillow garment 10 rests on the caregiver's upper front torso with one shoulder portion 11 resting on each of the caregiver's shoulders and a neck encircling potion 13 surrounding the front of the caregiver's neck, as shown in FIGS. 1 and 4. The padded pillow garment 10 is worn in this position to protect an infant's head from pain and injury when bobbing against the caregiver and protect to the caregiver's body and clothing. A single shoulder strap 20 extending from a top portion 12 to a bottom portion 16 of the cushion supports the padded pillow garment 10 when in use in combination with the friction of the fabric covering 14 of the padded pillow garment 10 against the caregiver's body.

When not in use, the padded pillow garment 10 is folded in half along a thin stitched vertical fold line 17 with a second half 12A and 16A tucked under a first half of the cushion 12 and 16, as shown in FIG. 5. The folded cushion 12, 12A, 16 and 16A is then swung around the shoulder, as indicated in FIG. 6, onto the caregiver's back with the shoulder portions 11 now resting near the caregiver's waist in the back and the shoulder strap 20 around the front of the shoulder, as shown in FIG. 7, enabling the caregiver to engage in normal daily activity with a free range of motion when not holding the infant. The padded pillow garment 10 is conveniently stored in the back position, shown in FIG. 7, for immediate access and frequent use. When needed, the folded cushion portion 12, 12A, 16 and 16A is quickly swung around to the folded front position shown in FIG. 5 with the shoulder strap 20 on the back of the shoulder and the underside cushion portion 12A and 16A unfolded from below the upper side cushion portion 12 and 16 and flattened out the to be worn in the infant-holding position shown in FIGS. 1 and 4.

To occupy and entertain the infant one or more articles may be removably attached to the cushion portion 12 and 16 or the shoulder portion 11 of the padded pillow garment 10, such as a teething ring 32 and a stuffed teddy bear 33, as shown in FIG. 2. The infant's entertainment articles 32 and 33 may be removably attached to an edge of the cushion 12 and 16 by a removable clip 30 and a tether 31, as shown in FIG. 2, for instant use by the infant. Any of a variety of other items (not shown) which can be used by an infant may be removably attached to the padded pillow garment 10, such as a pacifier, a teething cloth, a small toy, a small doll, a small action figure, and/or a rubberized toy. The entertainment articles 32 and 33 may be easily removed from the padded cushion 12 and 16 for easy cleaning or replacement with a different toy or infant's belonging. Alternately, other fastening systems (not shown) such as hook and loop fastener systems, tie strings, buttons, or snaps may be used to attach the infant amusement items 32 and 33 to the padded pillow garment 10.

It is understood that the preceding description is given merely by way of illustration and not in limitation of the invention and that various modifications may be made thereto without departing from the spirit of the invention as claimed.

What is claimed is:

1. A padded pillow protective garment worn on a front upper torso of a caregiver for use in holding an infant and alternately retained on a back of the caregiver during normal activity when not holding the infant, the garment comprising:

a padded pillow garment worn by a caregiver to an infant, the padded pillow garment comprising a resilient shock absorbent cushion to cover and cushion boney portions of the upper front torso and shoulders of the caregiver to cushion contact of the boney portions by the infant being held by the caregiver; the padded pillow garment comprising a semi-circular neck encircling portion, a front upper torso covering portion, a breast covering portion, two shoulder covering portions; a strap between a top and bottom of a first side of the padded pillow garment for encircling around a back of a shoulder of the caregiver to hold the padded pillow garment in place on a front of the caregiver's body shielding boney parts of the caregiver's body during use while holding an infant in front of the caregiver to protect the infant's head from pain and injury when bobbing against the caregiver and protect the caregiver's clothing and body from pain and staining fluids emitted by the infant; and a vertical fold line in the padded pillow garment from the neck encircling portion to a bottom of the padded pillow garment to enable the padded pillow garment to be folded in half vertically so that a second side of the padded pillow garment may fold under the first side along the vertical fold line and the padded pillow garment may be slung back over the shoulder and may hang down on the back of the caregiver with the strap extending over the shoulder and down in front of the caregiver when not holding an infant to enable normal activity by the caregiver while retaining the padded pillow garment behind the caregiver ready for instant use when needed for holding the infant, thereby providing a readily available padded pillow protective garment worn on a front upper torso of a caregiver for use in holding an infant and alternately retained on a back of the caregiver during normal activity when not holding the infant.

2. The garment of claim 1 wherein the resilient shock absorbent cushion tapers to a lesser thickness over the soft upper breast portion of the caregiver so that the padded pillow garment conforms to the shape of the shoulder and upper torso of the caregiver.

3. The garment of claim 1 wherein the vertical fold line comprises a stitched vertical line through the padded pillow garment to create a thin linear portion of the padded pillow garment forming the vertical fold line to enable folding the padded pillow garment along the vertical fold line.

4. The garment of claim 1 wherein the padded pillow garment is configured to cover an upper and front portion of the shoulders and an upper third of the torso of the caregiver partially covering the breasts of the caregiver to enable easy lifting of the padded pillow garment for breast feeding.

5. The garment of claim 1 wherein the padded pillow garment is fabricated of a memory foam shaped to form the padded pillow garment, the memory foam a sufficient thickness at the top to cover and cushion the boney portions of the caregiver's body while not allowing the infants face to sink into the padded pillow garment, and tapering to a thinner bottom over the breast area.

6. The garment of claim 1 further comprising a covering over the padded pillow garment formed of a breathable water resistant fabric to cover at least the outer face of the padded pillow garment to protect the clothing of the caregiver from fluids spilled in feeding and emitted from the mouth of the infant.

7. The garment of claim 6 wherein the fabric comprises an organic breathable water resistant fabric which may be colored, imprinted, and decorated as desired.

8. The garment of claim 7 wherein the fabric comprises a high friction fabric over the back of the padded pillow garment to resist slipping when in place for use on the front torso of the caregiver.

9. The garment of claim 1 further comprising at least one clip removably attachable to an edge of the padded pillow garment and an elongated element for attaching any of a variety of items to be used by an infant taken from the list of items used by an infant consisting of a teething ring, a teething cloth, a pacifier, a small toy, a small stuffed animal, a small doll, a small action figure, and a rubberized toy for instant use by the infant.

10. The garment of claim 1 wherein the resilient shock absorbent cushion comprises a sheet of shaped memory foam between 1⅛ inches and 1½ inches thick.

* * * * *